US008424678B2

(12) United States Patent
Anderson

(10) Patent No.: US 8,424,678 B2
(45) **Date of Patent: *Apr. 23, 2013**

(54) REINFORCED GOLF BAG BOTTOM

(75) Inventor: Douglas W. Anderson, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 496 days.

This patent is subject to a terminal disclaimer.

(21) Appl. No.: 12/550,297

(22) Filed: Aug. 28, 2009

(65) Prior Publication Data

US 2010/0300908 A1 Dec. 2, 2010

Related U.S. Application Data

(60) Provisional application No. 61/181,261, filed on May 26, 2009.

(51) Int. Cl.
*A63B 55/00* (2006.01)

(52) U.S. Cl.
USPC ..... 206/315.3; 206/315.6

(58) Field of Classification Search ..... 206/315.3, 206/315.6; 211/70.2
See application file for complete search history.

(56) References Cited

U.S. PATENT DOCUMENTS

| | | | | |
|---|---|---|---|---|
| 1,438,263 | A | 12/1922 | Rothschild | |
| 1,658,243 | A | 2/1928 | Kindwall | |
| 3,151,799 | A * | 10/1964 | Engles, Jr. et al. | 229/407 |
| D249,235 | S * | 9/1978 | Limon et al. | D9/425 |
| 5,112,068 | A | 5/1992 | Liao et al. | |
| 5,687,843 | A | 11/1997 | Yuill | |
| 5,705,213 | A * | 1/1998 | Guillin | 426/129 |
| 6,148,998 | A * | 11/2000 | Tan | 206/315.3 |
| 7,017,781 | B2 | 3/2006 | Provenza | |
| D615,760 | S * | 5/2010 | Anderson | D3/328.1 |
| 2004/0211687 | A1 * | 10/2004 | Rodriguez | 206/315.3 |
| 2004/0232016 | A1 | 11/2004 | Dietrich | |

* cited by examiner

*Primary Examiner* — Tri Mai
(74) *Attorney, Agent, or Firm* — Polsinelli Shughart PC; Ari Bai

(57) ABSTRACT

Embodiments of golf club bag bottoms and methods to manufacture golf club bag bottoms are generally described herein. Other embodiments may be described and claimed.

14 Claims, 8 Drawing Sheets

Fig. 6
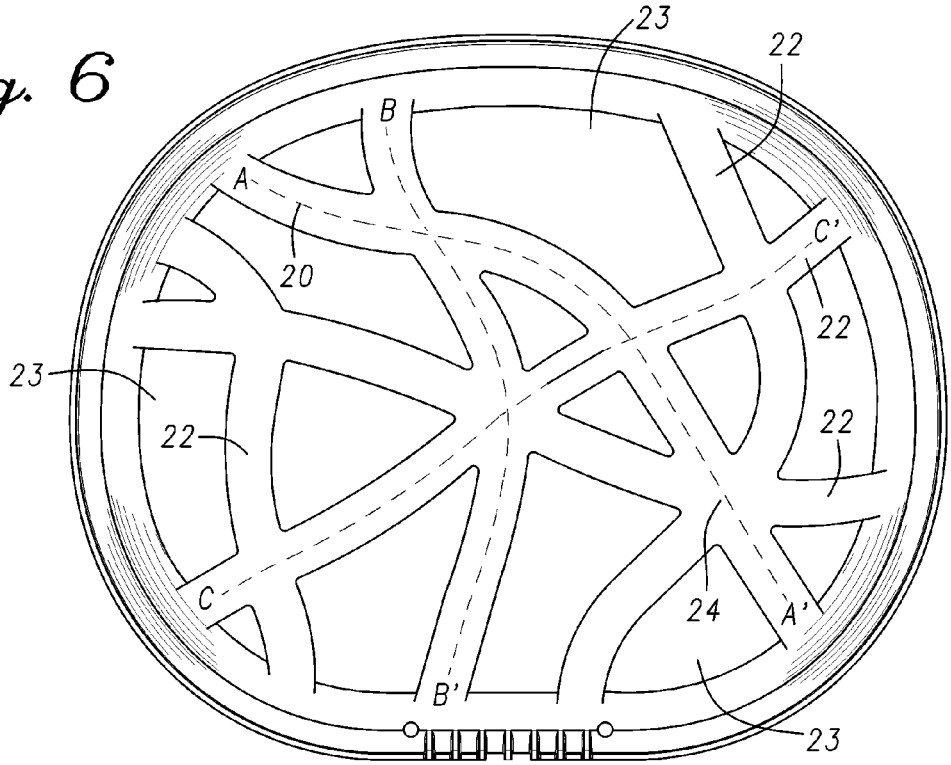
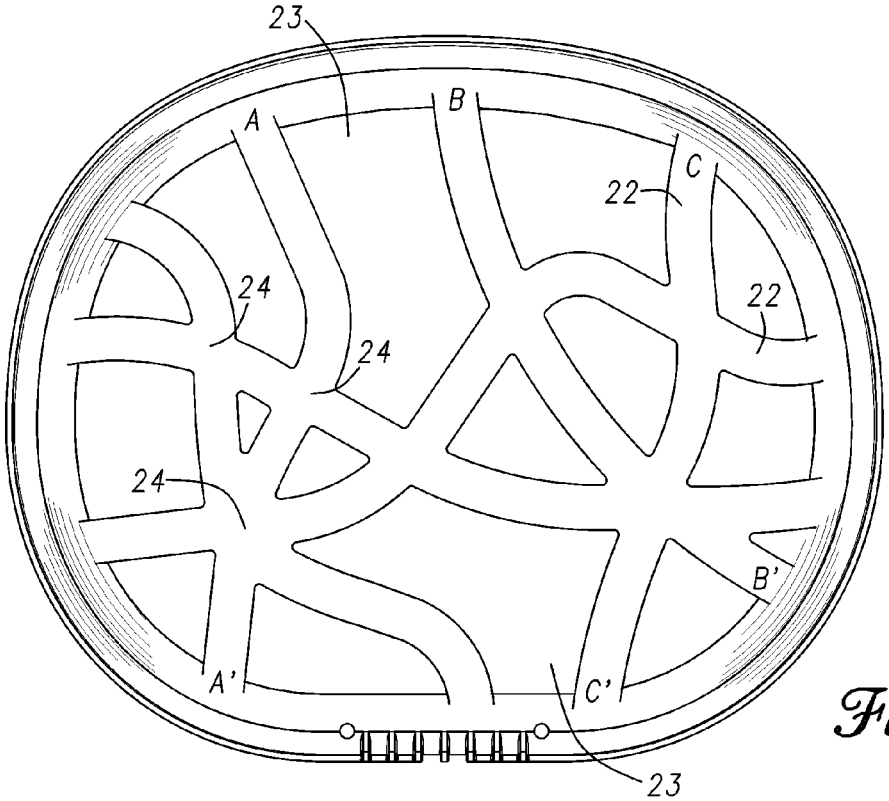
Fig. 7

Fig. 8
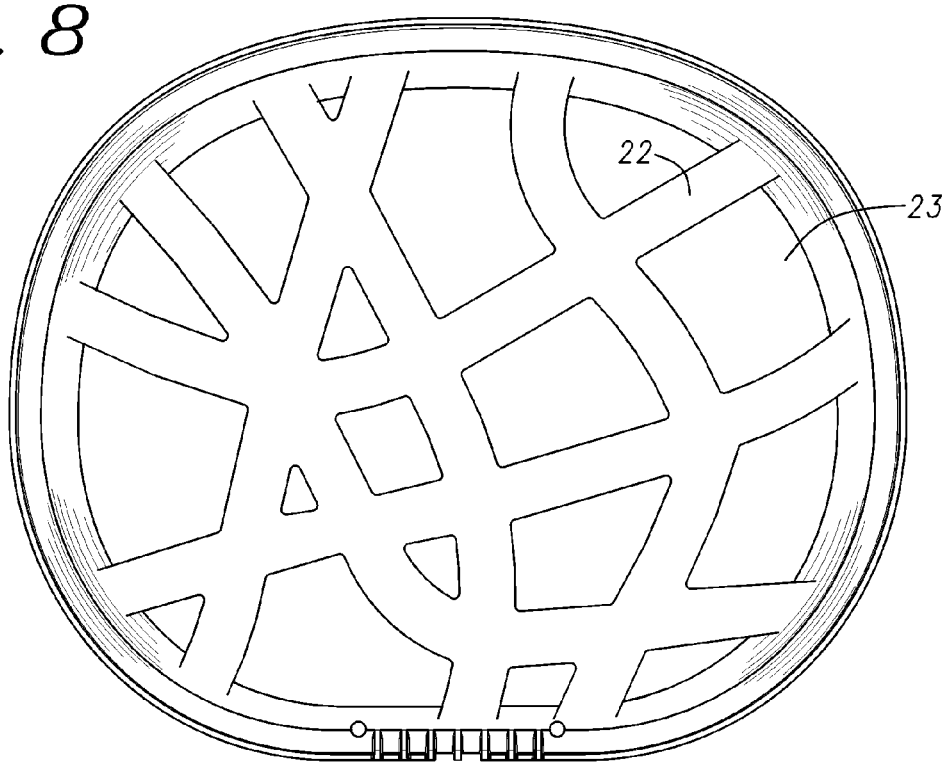
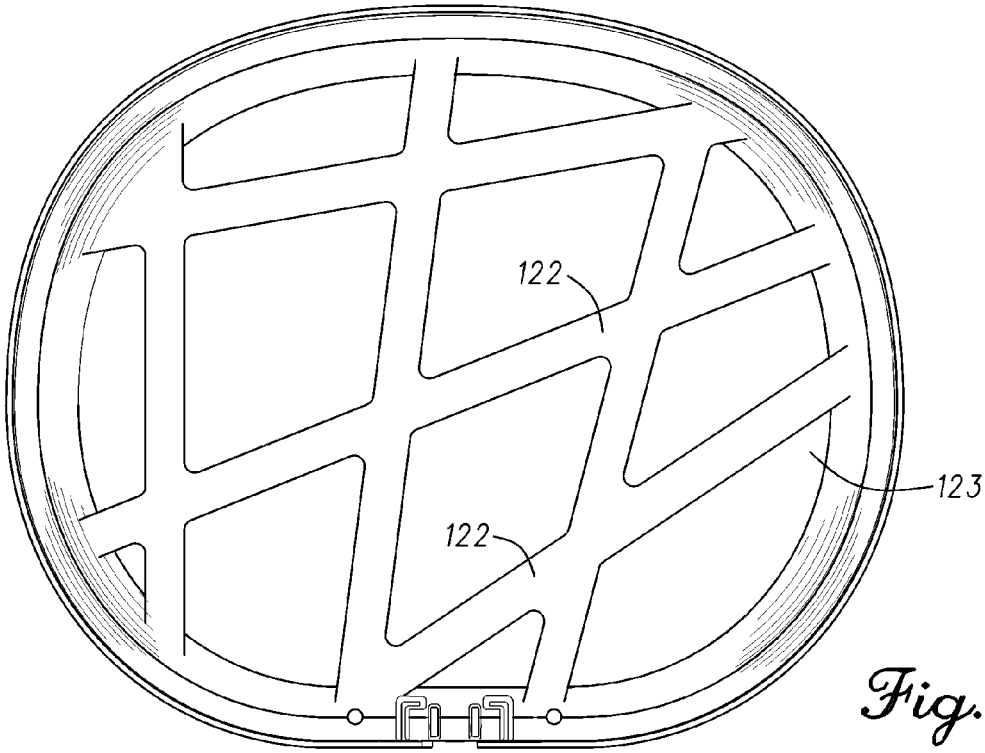
Fig. 9

REINFORCED GOLF BAG BOTTOM

CROSS REFERENCE TO RELATED APPLICATIONS

This application claims the benefit of the priority of U.S. Provisional Application Ser. No. 61/181,261, filed May 26, 2009.

TECHNICAL FIELD

The present disclosure relates generally to golf equipment, and more particularly to construction of bags for carrying golf clubs.

BACKGROUND OF THE INVENTION

Golf clubs are commonly transported on a golf course in golf bags, which generally are shaped as extended tubes with a closed bottom. Clubs may be stored in the bag with the handle or grip end down, so that the identity (type and number) of the club is apparent as the head protrudes from the top of the tube and the club is easily removed. Golf bags may be constructed from many types of materials, both natural and synthetic, and different parts of the bag may be of differing materials. It may be desirable for a golf bag to be strong enough to carry a set of golf clubs but weighing little itself.

Many designs of golf bags employ a smooth or flat bottom. When such a bottom is constructed of thin, light-weight material, the bottom may flex, bend or warp under the load of the clubs when the bag is lifted or carried. A reinforcing mechanism may resist warping and enable use of a thinner and lighter bottom material.

BRIEF DESCRIPTION OF THE DRAWINGS

FIG. 6 depicts a top view of an example golf bag bottom according to an embodiment of the methods, apparatus and articles of manufacture described herein, showing an example of a pattern of channels therein.

FIG. 7 depicts a top view of another example golf bag bottom according to an embodiment of the methods, apparatus and articles of manufacture described herein, showing a different example pattern of channels therein.

FIG. 8 depicts a top view of still another example golf bag bottom according to an embodiment of the methods, apparatus and articles of manufacture described herein, showing a different example pattern of channels therein.

FIG. 9 depicts a top view of still another example golf bag bottom according to an embodiment of the methods, apparatus and articles of manufacture described herein, showing a different example pattern of channels therein.

DESCRIPTION

In general, methods, apparatus and articles of manufacture associated with golf bag bottoms are described herein. The methods, apparatus and articles of manufacture described herein are not limited in this regard.

Figure 1:
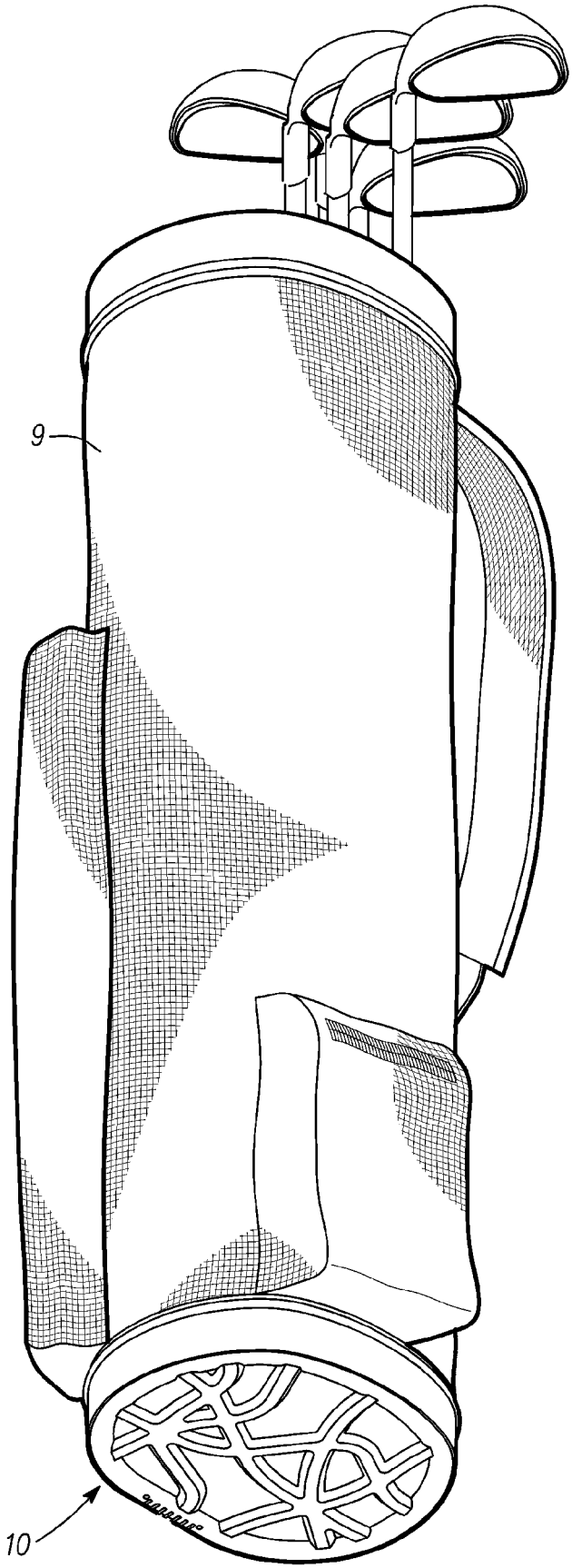
FIG. 1 depicts a golf bag with an example golf bag bottom according to an embodiment of the methods, apparatus and articles of manufacture described herein.
Figure 2:
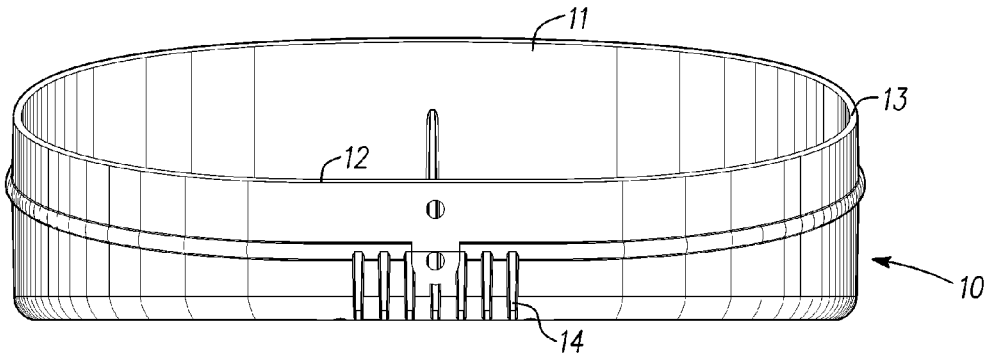
FIG. 2 depicts a front view of an example golf bag bottom according to an embodiment of the methods, apparatus and articles of manufacture described herein.
Figure 3:
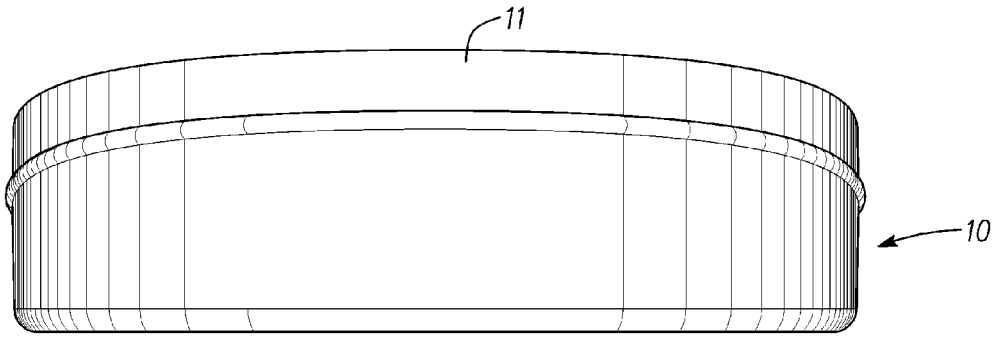
FIG. 3 depicts a back view of an example golf bag bottom according to an embodiment of the methods, apparatus and articles of manufacture described herein.
Figure 4:
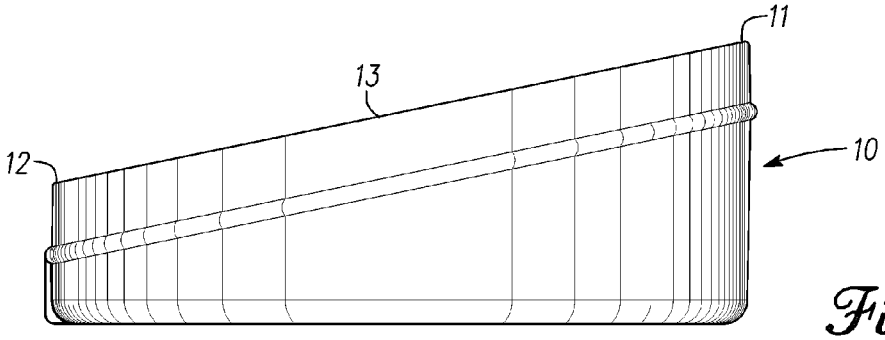
FIG. 4 depicts a side view of an example golf bag bottom according to an embodiment of the methods, apparatus and articles of manufacture described herein.

In some embodiments, golf bag bottoms are manufactured separately from the body or container portion of the golf bag and then attached thereto. FIGS. 2-4 depict a front, back and side views of an example golf bag bottom. In one example, a golf bag bottom (10) may include a rear wall (11), a front wall (12), side walls (13), and a plurality of reinforcing ridges (14). The rear wall (11) may be higher than the front wall (12). Continuously sloped side walls (13) complete a smooth transition between the rear wall (11) and the front wall (12). The plurality of reinforcing ridges (14) in the lower portion of the front wall (12) may protect the surface of the front wall from wear and tear (e.g., when the golf bag bottom (10) is dragged along the ground or when the golf bag is removed from a cart).

The golf bag bottom (10) shown in FIGS. 2-4 may be manufactured by injection molding but the manufacturing process is not limited in this regard. Different materials and methods may be used. Injection molded polypropylene is one advantageous example of a manufacturing material for some embodiments of a golf bag bottom.

An injection molded golf bag bottom may in some cases advantageously be made with a minimized thickness and thus lighter weight because a thinner injection molded golf bag bottom contains less material. A disadvantage of a thin golf bag bottom is that the bag bottom may flex under the load of the golf clubs. This can cause the bottom to bow or warp, possibly distorting the overall shape of the bag and possibly leaving the bottom uneven and the bag unstable when stood up on its bottom.

Figure 5:
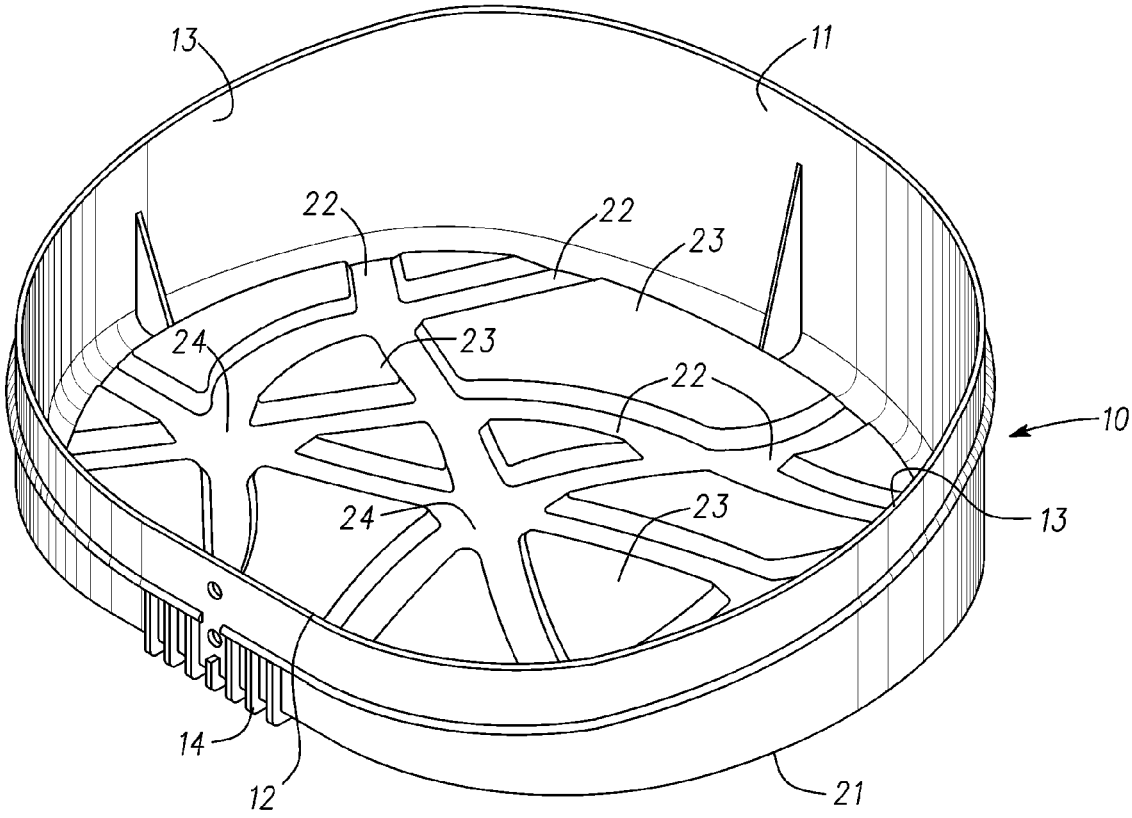
FIG. 5 depicts a perspective view of an example golf bag bottom according to an embodiment of the methods, apparatus and articles of manufacture described herein.

The incorporation of channels, or extended shallow depressions in a bottom surface of a golf bag bottom, assists in stiffening the bottom along the line of the axis of the channel. For example, FIG. 5 depicts an embodiment of a golf bag bottom with an example of a pattern of channels in the bottom surface (21). As noted above, the rear wall (11) of the golf bag bottom structure is higher than the front wall (12) and is connected smoothly thereto by the continuously sloped side walls (13). Reinforcing ridges (14) are incorporated at the lower portion of the front wall (12). The bottom surface (21) incorporates a plurality of shallow channels (22) running from one point on the periphery of the bottom surface to a second point on the periphery, as described below. The axis (20) of one of the channels (22) is shown for illustrative purposes in FIG. 6 by the dotted lines. Between the channels (22) are surface areas or "islands" (23), which may be elevated relative to the bottom surfaces of channels (22) when viewed from above as shown in detail below (e.g., FIGS. 10 and 11). Some channels (22) may cross other channels at intersection areas (24) or nodes. The methods, apparatus, and articles of manufacture described herein are not limited in this regard.

Figure 10:
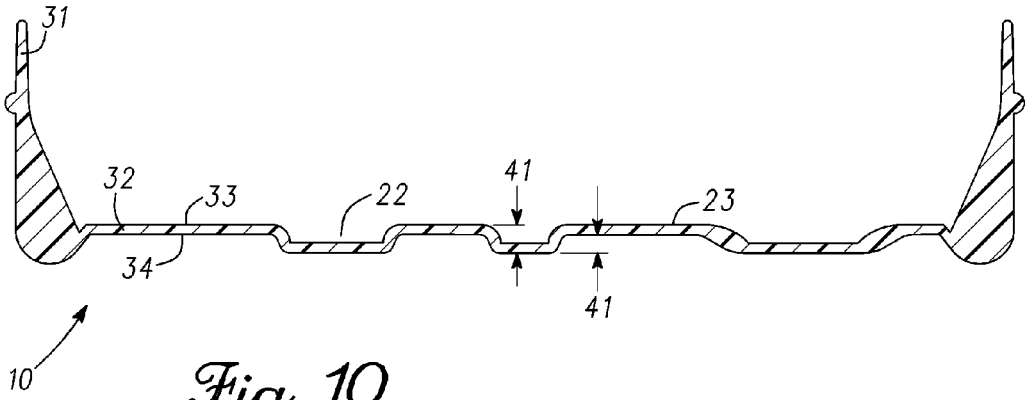
FIG. 10 depicts a side to side sectional view of an example golf bag bottom according to an embodiment of the methods, apparatus and articles of manufacture described herein, showing the channels and raised portions therein.
Figure 11:
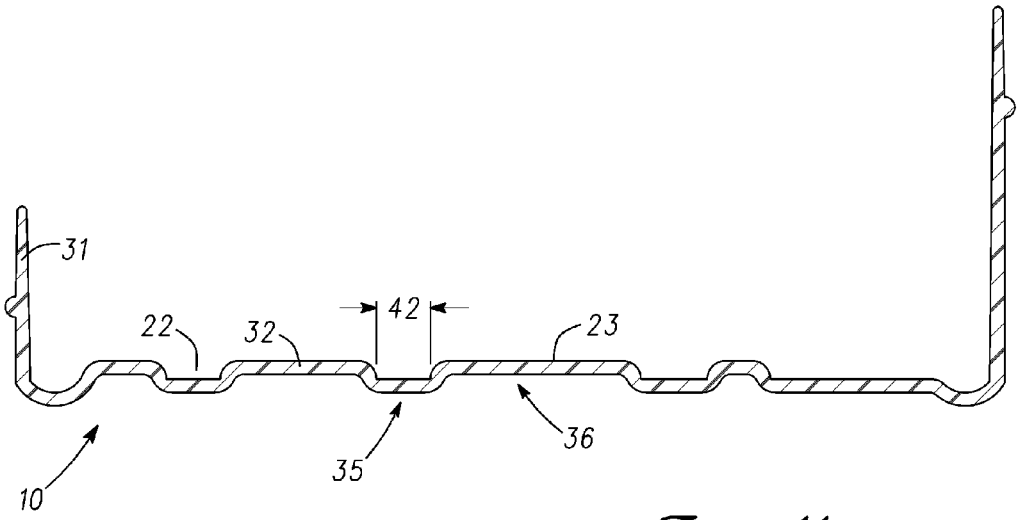
FIG. 11 depicts a front to back sectional view of an example golf bag bottom according to an embodiment of the methods, apparatus and articles of manufacture described herein, showing the channels and raised portions therein.

FIGS. 10 and 11 depict an embodiment of the channel structure in a cross sectional view. Golf bag bottom (10) is approximately uniform thickness through its walls (31) and bottom (32). The bottom (32) has an upper surface (33) inside the bag that may engage one or more golf clubs, and a lower surface (34) that rests on the ground. Channel depth (41) is the distance from the upper surface of an island (23) to the upper surface of an adjacent channel (22). When viewed from below, the channel portions (35) appear "raised" and the island portions (36) appear indented. The addition of the channel portions (35) as configured in conjunction with the island portions (36) reinforce the stability of the golf bag bottom (10), allowing the golf bag bottom (10) to be fabricated with minimal thickness yet maintaining sturdiness. A reinforced golf bag bottom with minimal thickness that uses less material may be less expensive to fabricate, and lighter in weight yet sturdier compared with other traditional golf bag bottoms.

In one illustrative embodiment of the golf bag bottom described herein, the structure is fabricated from injection molded polypropylene. For example, the thickness of the bag bottom and the walls is approximately 0.090 inches and the depth of the channel (e.g., the channel depth (41) of FIG. 10) is 0.150 inches from the upper surface of an island to the upper surface of an adjacent channel. In this example, the width (42) of a channel is approximately 0.443 inches. The methods, apparatus, and articles of manufacture described herein are not limited in this regard.

FIGS. 6-9 depict examples of patterns of channels that provide enhanced stiffness to a golf bag bottom. The dotted lines in FIG. 6 depict an example of an axis (20) of a channel (22). Each channel (22) has a pair of channel ends (generally shown as A and A'; B and B'; C and C'; etc.) on the periphery of the bottom surface of the golf bag bottom. Channel ends (A, A'; B, B'; C, C') are generally anchored on opposite sides of the bottom, but in some pattern variations, anchoring of a channel to adjacent sides may be advantageous. Stiffness reinforcement imparted by a channel is primarily at the channel sides and in the direction of the channel's axis (20), as depicted by the dotted lines in FIG. 6, so a curvilinear channel provides reinforcement in more directions than does a straight channel. A plurality of curved channels, each turning through multiple orientations, can provide in the aggregate stiffness reinforcement in all 360 degrees of orientation along the bag bottom. FIGS. 6-8 depict samples of curved pattern sets that accomplish reinforcement in all directions. FIG. 9 depicts an alternative pattern of straight channels (122) that provides multidirectional reinforcement across more degrees of orientation than a grid pattern. A plurality of straight channels (122) that diverge in multiple directions, configured through multiple orientations, can provide in the aggregate stiffness reinforcement in almost 360 degrees of orientation along the bag bottom. The plurality of straight channels (122) configured and diverging from a grid pattern accomplish reinforcement in all directions, whereas a grid pattern otherwise may be more susceptible to bending across any axis perpendicular to the grid pattern of channels.

Figure 12:
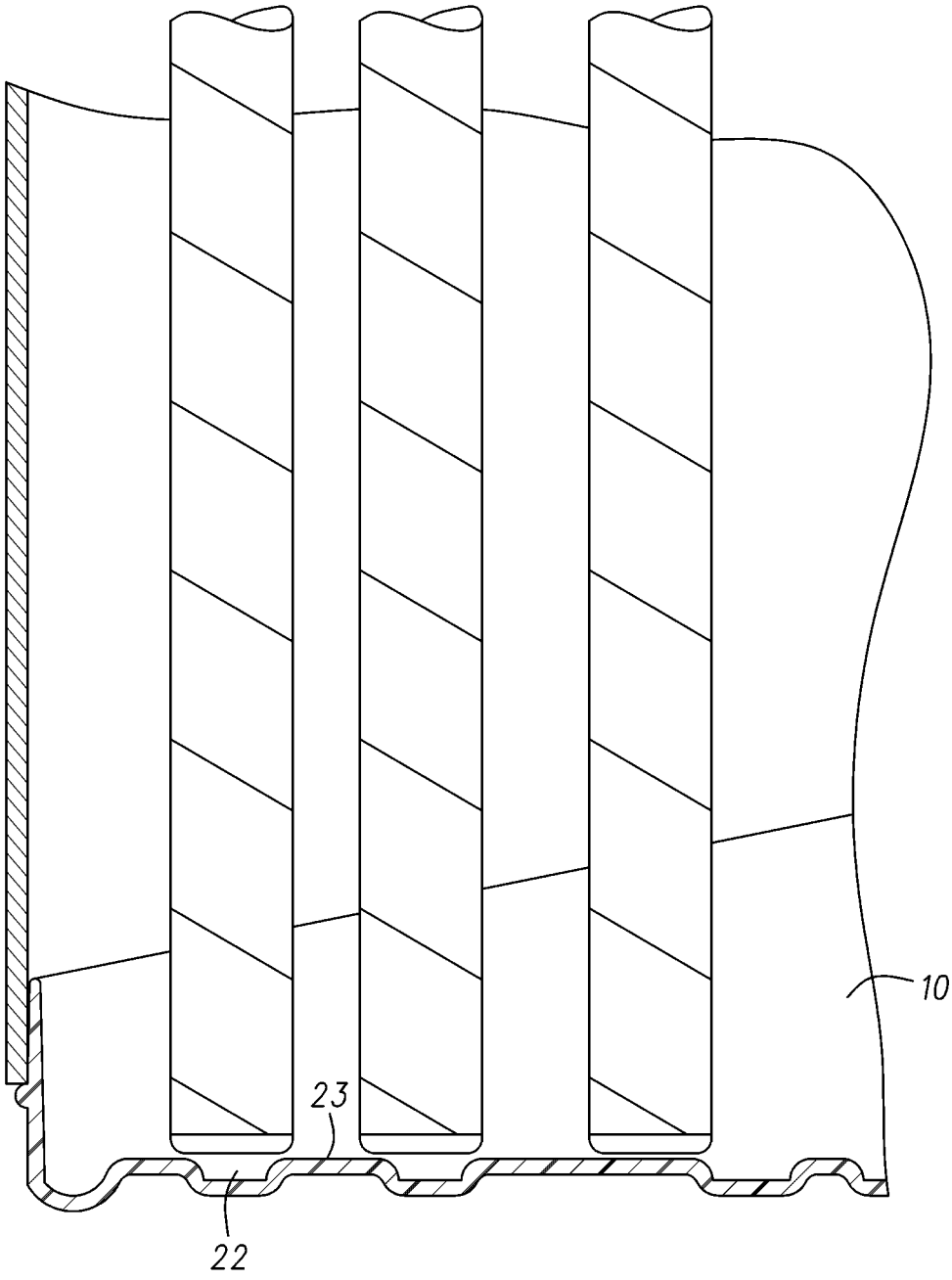
FIG. 12 depicts a side to side section view of an example golf bag bottom according to an embodiment of the methods, apparatus and articles of manufacture described herein, showing the channels, raised portions and golf club heads resting on the raised portions therein.
Figure 13:
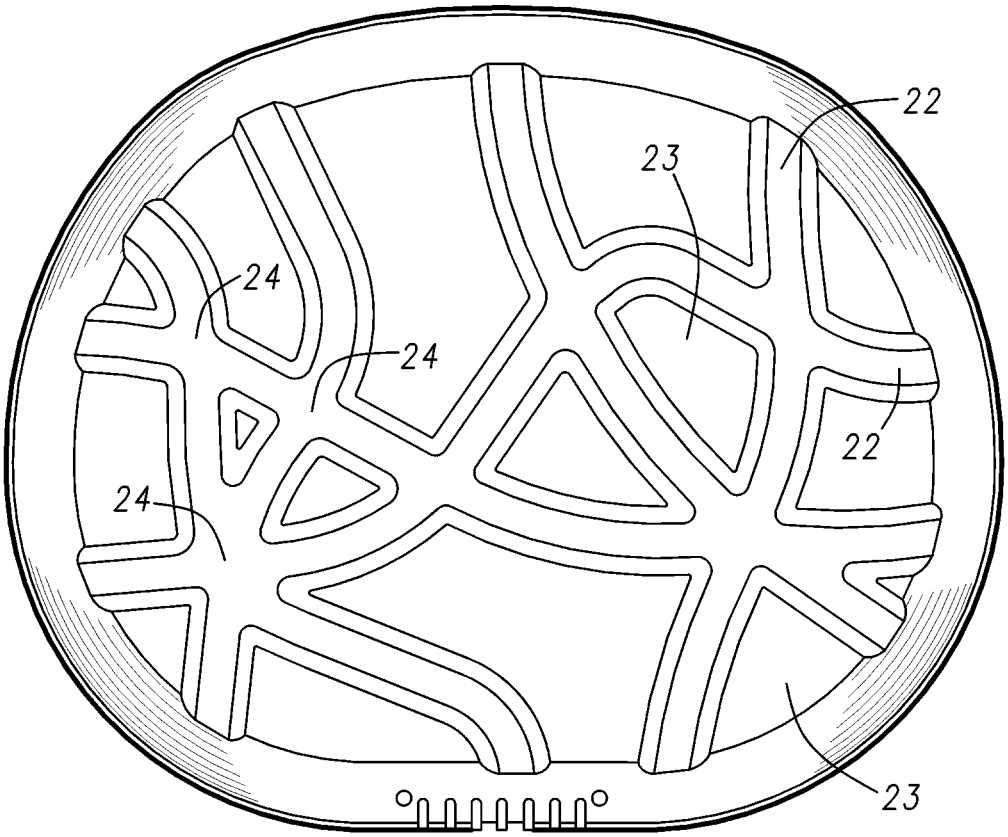
FIG. 13 depicts a bottom view of an example golf bag bottom according to an embodiment of the methods, apparatus and articles of manufacture described herein, showing an example of a pattern of channels therein.

In some embodiments, channel size and patterns may be configured based on the characteristics of golf club grips. In one example, the channel width (42) may be configured so that the grip of a club may rest on an island (23) instead of a channel (22). As a result, the club handle may be kept dry in the event that water gathers in the bottom of the channels. For the same reason, intersections or nodes (24) of the channels (22) may be configured so that a grip cannot fit into the depressed surface but rests instead on one or more adjacent island portions. FIG. 12 depicts an example of a pattern of channels (22) that are configured so that a golf club grip cannot fit into the channels (22) but instead rests on one of more adjacent island portions (23).

While a large variety of potential channel patterns is possible, certain non-binding guiding criteria will make the pattern more effective. The channels may be laid out so that the golf bag bottom does not include large islands or raised flat areas that may flex unduly. Also, no more than three channels should intersect at any point, and multiple channels may have different anchor points on the periphery of the bottom surface. Further, the majority of channels in the pattern may be anchored on opposite sides of the periphery, and the aggregate of the orientations of the channel axes should sweep 360 degrees at least once.

The foregoing description has been presented and is intended for the purposes of illustration and description. It is not intended to be exhaustive nor limit the invention to the precise form disclosed and many modifications and variations are possible in the light of the above teachings. The embodiments were chosen and described in order to explain the principles of the invention and its practical application and to enable others skilled in the art to utilize the invention in various embodiments and with various modifications as are suited to the particular use contemplated. Therefore, it is intended that the invention not be limited to the particular embodiments disclosed for carrying out the invention, but to cover all methods, apparatus and/or articles of manufacture falling within the scope of the appended claims either literally or under the doctrine of equivalents.

What is claimed is:

1. A golf bag bottom comprising:

a bottom surface portion associated with a periphery having a plurality of periphery walls; and a plurality of shallow reinforcing channels, at least one of the plurality of shallow reinforcing channels extending between two or more periphery walls of the plurality of periphery walls, wherein at least one of the plurality of shallow reinforcing channels is associated with a raised area, and each of the plurality of shallow reinforcing channels has an alignment direction that changes in a curvilinear pattern so that the alignment directions of the plurality of shallow reinforcing channels turn through multiple orientations, wherein at least four of the plurality of reinforcing channels intersect each other at a common intersection, wherein the plurality of shallow reinforcing channels intersect at nodes, the width of the nodes being smaller than the diameter of a golf club grip.

2. The golf bag bottom of claim 1, wherein the width of at least one of the plurality of the shallow reinforcing channels is smaller than the diameter of a golf club grip.

3. The golf bag bottom of claim 1, wherein the golf bag bottom comprises an injection molded polypropylene.

4. The golf bag bottom of claim 1, wherein two or more of the plurality of shallow reinforcing channels intersect at nodes.

5. The golf bag bottom of claim 1, wherein at least one channel of the plurality of reinforcing shallow channels has origination and termination points on opposite sides of the periphery.

6. The golf bag bottom of claim 1, wherein at least one channel of the plurality of reinforcing shallow channels has origination and termination points on adjacent sides of the periphery.

7. The golf bag bottom of claim 1, wherein at least one of the plurality of shallow reinforcing channel comprises a channel depth of approximately 0.150 inches.

8. The golf bag bottom of claim 1, wherein at least one of the plurality of shallow reinforcing channel comprises a channel width of approximately 0.443 inches.

9. A golf bag having a bottom portion comprising:

a bottom surface portion associated with a periphery having a plurality of periphery walls; and a plurality of shallow reinforcing channels, at least one of the plurality of shallow reinforcing channels extending between two or more periphery walls of the plurality of periphery walls, wherein at least one of the plurality of shallow reinforcing channels is associated with a raised area, and each of the plurality of shallow reinforcing channels has an alignment direction that changes in a curvilinear pattern so that the alignment directions of the plurality of shallow reinforcing channels turn through multiple orientations, wherein the plurality of shallow reinforcing channels intersect at nodes, the width of the nodes being smaller than the diameter of a golf club grip.

10. The golf bag of claim 9, wherein the width of at least one of the plurality of the shallow reinforcing channels is smaller than the diameter of a golf club grip.

11. The golf bag of claim 9, wherein the golf bag bottom comprises an injection molded polypropylene.

12. The golf bag of claim 9, wherein two or more of the plurality of shallow reinforcing channels intersect at nodes.

13. The golf bag of claim 9, wherein at least one channel of the plurality of reinforcing shallow channels has origination and termination points on opposite sides of the periphery.

14. The golf bag of claim 9, wherein at least one channel of the plurality of reinforcing shallow channels has origination and termination points on adjacent sides of the periphery.

* * * * *